US007604238B2

(12) United States Patent
Verstraeten

(10) Patent No.: US 7,604,238 B2
(45) Date of Patent: Oct. 20, 2009

(54) GRABBING DEVICE AND METHOD FOR CONTROLLING THE GRIPPING FORCE

(75) Inventor: Eric Ernest Maria Verstraeten, Sint-Niklaas (BE)

(73) Assignee: ELAUT N.V., Sint-Niklaas (BE)

( * ) Notice: Subject to any disclaimer, the term of this patent is extended or adjusted under 35 U.S.C. 154(b) by 428 days.

(21) Appl. No.: 11/715,618

(22) Filed: Mar. 7, 2007

(65) Prior Publication Data

US 2007/0210523 A1 Sep. 13, 2007

(30) Foreign Application Priority Data

Mar. 7, 2006 (BE) ..... 2006/0143

(51) Int. Cl.
*A63F 9/00* (2006.01)

(52) U.S. Cl. ..... 273/448

(58) Field of Classification Search ..... 273/440, 273/447, 448

See application file for complete search history.

(56) References Cited

U.S. PATENT DOCUMENTS

| | | | | |
|---|---|---|---|---|
| 5,271,628 | A * | 12/1993 | Okada | 273/448 |
| 5,855,374 | A | 1/1999 | Shoemaker, Jr. | |
| 6,283,475 | B1 | 9/2001 | Stubben | |
| 6,770,001 | B1 * | 8/2004 | Shoemaker, Jr. | 473/447 |
| 7,334,798 | B2 * | 2/2008 | Halliburton | 273/447 |
| 2003/0151202 | A1 | 8/2003 | Fisher et al. | |
| 2004/0011805 | A1 | 1/2004 | Crompton | |
| 2005/0218602 | A1 | 10/2005 | Watanabe et al. | |
| 2006/0255544 | A1 * | 11/2006 | Halliburton | 273/447 |
| 2007/0210523 | A1 * | 9/2007 | Verstraeten | 273/447 |
| 2008/0001360 | A1 * | 1/2008 | Fukazawa | 273/448 |

FOREIGN PATENT DOCUMENTS

| | | |
|---|---|---|
| EP | 1 233 824 | 8/2002 |
| WO | WO 2004/026415 | 4/2004 |

* cited by examiner

*Primary Examiner*—Raleigh W. Chiu
(74) *Attorney, Agent, or Firm*—Kenyon & Kenyon LLP

(57) ABSTRACT

A device for picking up one or more objects, e.g., particular one or more prizes to be won, and subsequently moving the same to a dispensing position includes: a pick-up device, such as a grabber or a vacuum head; and a positioning device to be controlled by a user for positioning the pick-up device over one or more objects. A weight determination device is provided for determining the weight of the pick-up device, in which one or more picked up objects may be present in case of a successful pick-up attempt, or of a variable related to the weight.

26 Claims, 7 Drawing Sheets

GRABBING DEVICE AND METHOD FOR CONTROLLING THE GRIPPING FORCE

CROSS-REFERENCE TO RELATED APPLICATIONS

The present application claims priority to Application No. 2006/00143, filed in the Kingdom of Belgium on Mar. 7, 2006, which is expressly incorporated herein in its entirety by reference thereto.

FIELD OF THE INVENTION

The present invention relates to a device for picking up one or more objects, e.g., one or more prizes to be won, and subsequently moving the same to a dispensing position. The device may include: a pick-up device, such as a grabber or a vacuum head; and a positioning device to be controlled by a user for positioning the pick-up device over one or more objects.

BACKGROUND INFORMATION

Such devices are generally known in game machines provided with a grabber or a vacuum head. A game machine provided with a grab crane is described, for example, in European Published Patent Application No. 1 233 824, which describes the use of an infrared sensor or switch for detecting the presence of a prize in the grabber claws. This is only a purely theoretical possibility, however, which is not very feasible in practice. Because of the available mounting possibilities and the spatial limitations, an infrared sensor is very difficult to incorporate in a normally functioning grabber.

U.S. Pat. No. 5,855,374 describes a game machine of the kind described in the introduction fitted with a vacuum head. This device is provided with a vacuum sensor for detecting the presence of a prize in the vacuum head.

SUMMARY

Example embodiments of the present invention provide a device for picking up one or more objects which provides prize detection in a simple manner and which moreover makes it possible to derive the type of prize in case several prizes are available, and that, e.g., during or immediately after grabbing/picking up the object(s).

The device may include a weight determination device for determining the weight of the pick-up device, in which one or more picked up objects may be present in case of a successful pick-up attempt, or of a variable related to the weight.

From the weight determined by the weight determination device, it may be readily be derived whether one or more objects is/are picked up and also what object is picked up.

It is described, for example, in U.S. Patent Application Publication No. 2003/0151202 to provide the game machine with a scale. The picked-up objects must first be placed on the scale, however, before they can be weighed.

The weight determination device hereof may include a weighing cell. The pick-up device, such as a grabber or a vacuum head, is typically suspended from a vertical movement device. In the arrangement provided with the weighing cell, the vertical moving device may be suspended from the weighing cell together with the pick-up device. In this manner, the weighing cell can determine the weight of the vertical movement device and of the pick-up device, in which an object may or may not be present.

The weight determination device may include a pressure sensor. The vertical moving device of such an arrangement is movably, e.g., pivotally, mounted and the pressure sensor is provided such that the vertical moving device exerts a pressure force on the pressure sensor by its own weight and by the weight of the pick-up device connected thereto. When an object is picked up by the pick-up device, the weight, and thus the pressure force exerted on the pressure sensor, increases. The pressure measured by the pressure sensor is thus a measure of the weight of the object in the grabber.

A control device for controlling the pick-up force, e.g., the gripping force, may be provided, which is capable of controlling the pick-up force as a function of the weight determined by the weight determination device. This makes it possible to increase the gripping force when few objects are grabbed during a predetermined period, for example, or to decrease the gripping force when an object is being grabbed, so that the object will slip from the grabber claws.

Furthermore, a sound animation device may be provided, which is controlled by a control unit on the basis of the weight determined by the weight determination device. Instead of or in addition to a sound animation device, a visual animation device, an audiovisual animation device, etc., may be provided.

A control unit may be provided for controlling the vertical moving device of the basis of the weight determined by the weight determination device. For example, if the measured weight G is lower than a predetermined critical value $G_{crit}$, it may be decided that the pick-up device has reached the playing area, whereupon the moving device is controlled to move back upwardly. At the same time, the device for controlling the gripping force of the grabber claws are instructed to close the grabber claws (for a grabber), or to activate the vacuum source (for a vacuum head).

The positioning device may include a carriage which is horizontally movable, from which carriage the pick-up device is suspended. The positioning device may include a (for example, rotatably) movable bottom, on which the objects to be grabbed are present. Other arrangements are also possible.

A method is for setting up a device, such as those described above, during an initialization procedure. According to the method, the weight of all the different types of objects to be picked up, or of a variable related to the weight, is determined and stored. Furthermore, the required pick-up force for every type of object may be determined, whether or not automatically, and be stored. By subjecting the device to such an initialization procedure, a suitable gripping force may be set during the game according to the weight of the picked-up object. Furthermore, animation effects may also be linked to the weight of a particular object, for example.

Furthermore, statistical data, such as win statistics, of a device, such as those described above, may be readily determined by storing the determined weight for every pick-up attempt. By storing the data, it may thus be derived how many successful and unsuccessful pick-up attempts are made and what objects are picked up.

A method is for controlling the pick-up force in a device for picking up one or more objects and subsequently moving the same to a dispensing position. The weight of the pick-up device, e.g., with one or more objects present therein, or a variable related to the weight, is determined. From the weight, it is subsequently derived whether an object is picked up. It may also be derived therefrom which object is picked up. The pick-up force of the pick-up device may be adjusted on the basis of the determined weight, for example, for the purpose of increasing or decreasing the winning chance.

According to an example embodiment of the present invention, a device for picking up at least one object, e.g., at least one prize to be won, and subsequently moving the at least one object to a dispensing position includes: a pick-up device, e.g., at least one of (a) a grabber and (b) a vacuum head; a positioning device controllable by a user to position the pick-up device over at least one object; a weight determination device configured to determine at least one of (a) a weight of the pick-up device, in which at least one picked-up item is present for a successful pick-up attempt, and (b) a variable related to the weight; and a control device configured to control a pick-up force as a function of the weight determined by the weight determination device.

The weight determination device may include a weighing cell.

The device may include a vertical movement device suspended from the weighing cell with the pick-up device.

The weight determination device may include a pressure sensor.

The device may include a vertical movement device, the pick-up device may be suspended from the vertical movement device, the vertical movement device may be movably mounted, and the vertical movement device may exert a pressure force on the pressure sensor by its own weight and by weight of the pick-up device, in which at least one object may be present.

The vertical movement device may be pivotally connected to a carriage movable in a horizontal plane by the positioning device, the carriage may include an abutment surface, and the pressure sensor may be attached to the abutment surface.

A repeat control function may be configured to provide a further pick-up attempt if the weight determined on a first pick-up attempt indicates that no object was picked up.

The device may include: an audiovisual animation device; and a control unit configured to control the audiovisual animation device in accordance with the weight determined by the weight determination device.

According to an example embodiment of the present invention, a device for picking up at least one object of at least one type, e.g., at least one prize to be won and subsequently moving the at least one object to a dispensing position includes: a pick-up device, e.g., at least one of (a) a grabber and (b) a vacuum head; a positioning device controllable by a user to position the pick-up device over at least one object; a weight determination device configured to determine at least one of (a) a weight of the pick-up device, in which at least one picked-up item is present for a successful pick-up attempt, and (b) a variable related to the weight; and a control unit configured to derive a type of object on in accordance with the weight determined by the at least one of (a) the weight and (b) the variable related to the weight.

According to an example embodiment of the present invention, a device for picking up at least one object, e.g., at least one prize to be won, and subsequently moving the at least one object to a dispensing position includes: a pick-up device, e.g., at least one of (a) a grabber and (b) a vacuum head; a positioning device controllable by a user to position the pick-up device over at least one object; a weight determination device configured to determine at least one of (a) a weight of the pick-up device, in which at least one picked-up item is present for a successful pick-up attempt, and (b) a variable related to the weight; a vertical movement device configured to move the pick-up device up and down; and a control unit configured to control the vertical movement device in accordance with the weight determined by the weight determination device.

According to an example embodiment of the present invention, a method for setting up a device during an initialization procedure of a device for picking up at least one object of at least one type, e.g., at least one prize to be won, and subsequently moving the at least one object to a dispensing position, which the device including a pick-up device and a positioning device controllable by a user to position the pick-up device over at least one object, includes: (a) determining at least one of (a) a weight of all types of objects to be picked up and (b) a variable related to the weight by a weight determination device; and (b) storing the at least one of (a) the weight of all types of objects to be picked up and (b) the variable related to the weight determined in the determining step (a).

The method may include: (c) determining a required pick-up force for every type of object; and (d) storing the required pick-up force determined in the determining step (c).

The required pick-up force may be determined in the determining step (c) at least one of (a) automatically and (b) non-automatically.

According to an example embodiment of the present invention, a method for determining statistical data of a device for picking up at least one object of at least one type, e.g., at least one prize to be won, and subsequently moving the object to a dispensing position, the device including a pick-up device and a positioning device controllable by a user to position the pick-up device over at least one object, includes: for each pick-up attempt, determining a weight of a picked up object; and storing the weight determined in the determining step.

According to an example embodiment of the present invention, a method for controlling a device for picking up at least one object of at least one type, e.g., at least one prize to be won, and subsequently moving the object to a dispensing position includes: determining at least one of (a) a weight of the pick-up device, in which at least one object is present for a successful pick-up attempt, and (b) a variable related to the weight; deriving, from the determined weight, whether an object was picked up; and deriving, from the determined weight, which type of object was picked up.

The method may include adjusting a pick-up force in accordance with the determined weight to at least one of (a) increase and (b) decrease a winning chance.

The method may include: deriving, in accordance with the determined weight, if a picked-up object is falling from the pick-up device; and adjusting the pick-up force if it is derived that the picked-up object is falling.

The above and further features and aspects of example embodiments of the present invention are described in more detail below with reference to the appended Figures.

DETAILED DESCRIPTION

Figure 1:
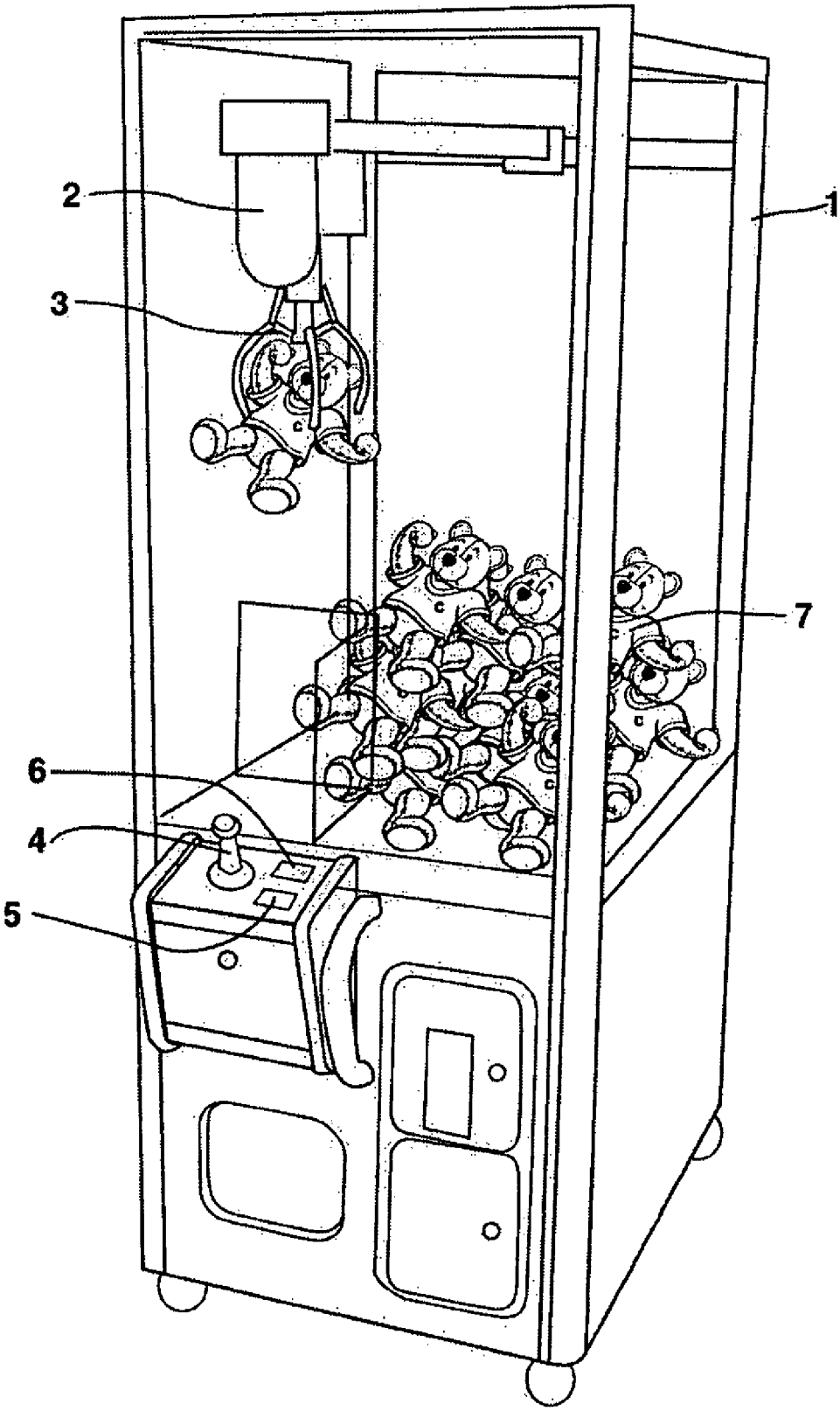
FIG. 1 is a perspective view of a game machine provided with a device according to an example embodiment of the present invention.

FIG. 1 illustrates a game machine that includes a cabinet 1, in which a number of prizes 7, which may or may not be different from each other, are present. The cabinet may be of any suitable design. A horizontally movable carriage 2 is provided in the higher part of the cabinet, from which carriage a pick-up device, e.g., a grabber 3, is suspended by a flexible element, for example, a chain. The cabinet is further provided with controls 4, 5, 6, which are to be operated by a player. The carriage 2 may be moved in a horizontal field by a joystick 4. Besides a joystick, also other devices, such as arrow keys, may be provided and/or suitable. Furthermore buttons 5, 6 may be provided, for example, a start button, a button by which a player may indicate that he or she wishes to make a grab attempt, and/or a button by which a second or further grab attempt may be made at the position where the grabber comes up empty or at the position where the object is lost. A weight determination device is incorporated in the carriage 2, explained hereinafter with reference to FIGS. 2A and 2B.

Figure 2A:
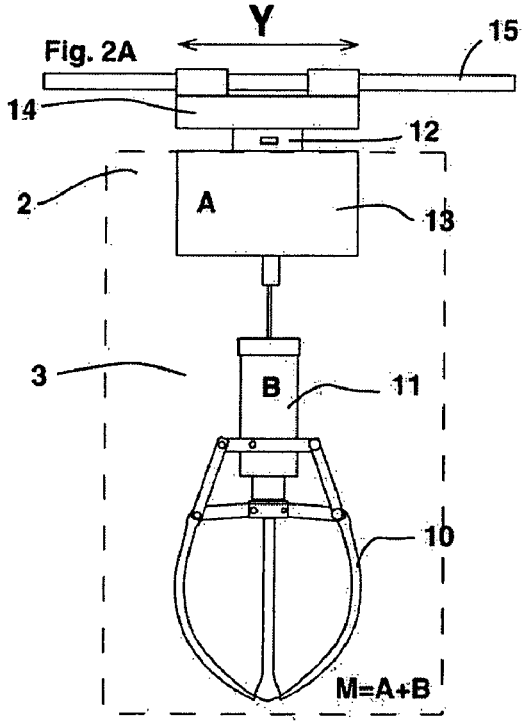
FIGS. 2A and 2B schematically illustrate a device according to an example embodiment of the present invention in positions with and without, respectively, an object in a grabber.
Figure 2B:
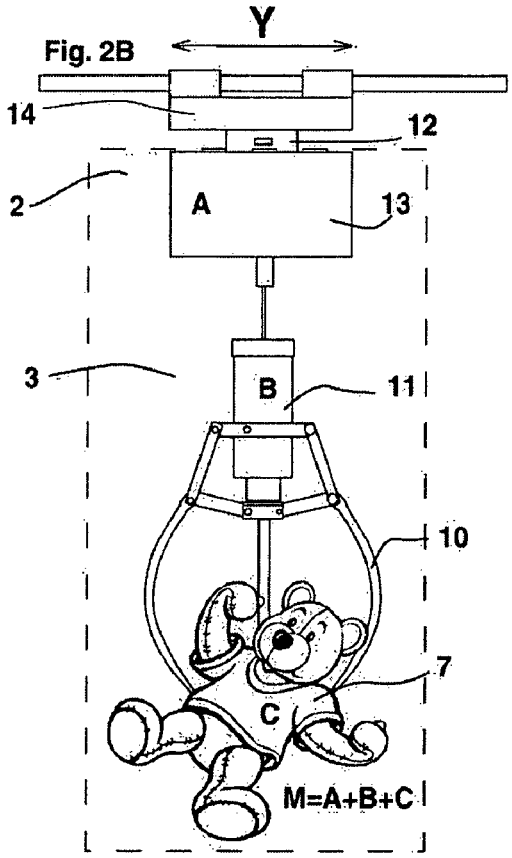

FIGS. 2A and 2B illustrate a device according to an example embodiment of the present invention. The device includes: a pick-up device, e.g., a grabber 3; and a positioning device to be controlled by an operator for positioning the grabber 2 over a prize he or she wishes to grab. Possible positioning devices are explained hereinafter with reference to FIGS. 7 and 8.

The grabber 3 includes three grabbing claws 10 and device 11 for opening and closing the grabbing claws, which device is controllable from a central control unit, as described hereinafter. FIG. 2A illustrates a grabber with the grabbing claws in a closed position, with no prize being present in the grabber, whereas FIG. 2B illustrates a situation in which a prize is present in the grabber claws.

The carriage 2 is movable in the Y-direction along a section 15. The carriage 2 includes an upper part 14, vertical moving device 13, and weighing device 12. The weighing device 12 is disposed between the upper part 14 and the vertical moving device 13. The pick-up device is suspended from the vertical moving device 13. In this example embodiment, the weighing device 12 thus measures the mass of the vertical moving device A plus the mass of the pick-up device B plus the mass of an object C that may have been picked up by the grabber, e.g., the total weight M=A+B (without an object) or M=A+B+C (with an object C).

Figure 3A:
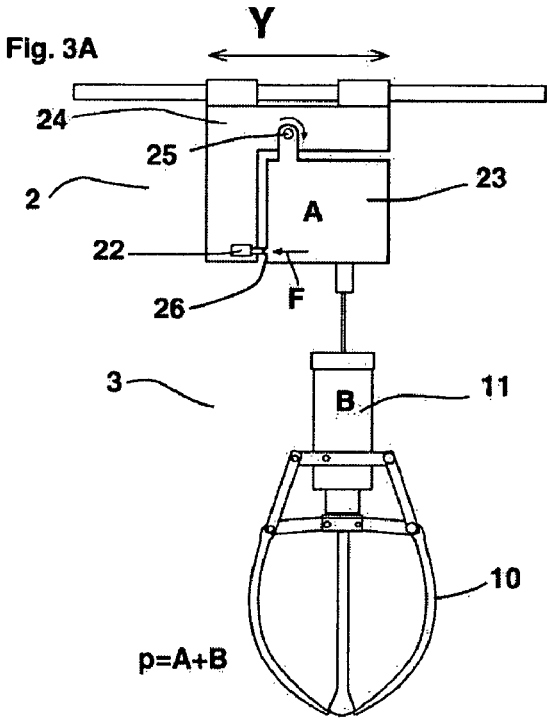
FIGS. 3A and 3B schematically illustrate a device according to an example embodiment of the present invention in positions with and without, respectively, an object in a grabber.
Figure 3B:
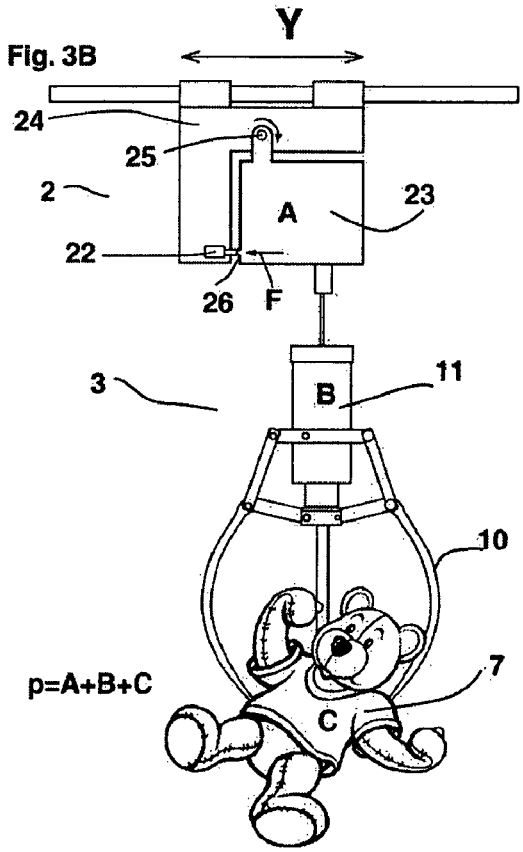

A device according to an example embodiment of the present invention is described with reference to FIGS. 3A and 3B. The grabber 3 is identical to the grabber as described with reference to FIGS. 2A and 2B and is therefore not explained in further detail. The carriage 2 includes an upper part 24 having an L-shaped section, from which a part 23, in which the moving device is accommodated, is pivotally suspended. The locations of the pivot point 25 and of the suspension point of the grabber 3 are selected so that the part 23 tends to tilt in clockwise direction. As a result, the part 23 will make contact with the L-shaped upper part 24. It stands to reason that the upper part 24 is configured to provide such contact. A pressure sensor 22 is provided in the upper part 24, at the location where the part 23 makes contact with the upper part. In this manner, the pressure measured by the pressure sensor is related to the mass of the part 23 provided with the moving device, plus the mass of the grabber, in which an object may or may not be present. The pressure sensor thus measures a variable which, in the case of an empty grabber, is a measure of the mass of the part 23 A plus the mass of the grabber B and, in the case of an object being picked up, equals A plus B plus the mass of the picked-up object C.

Figure 4:
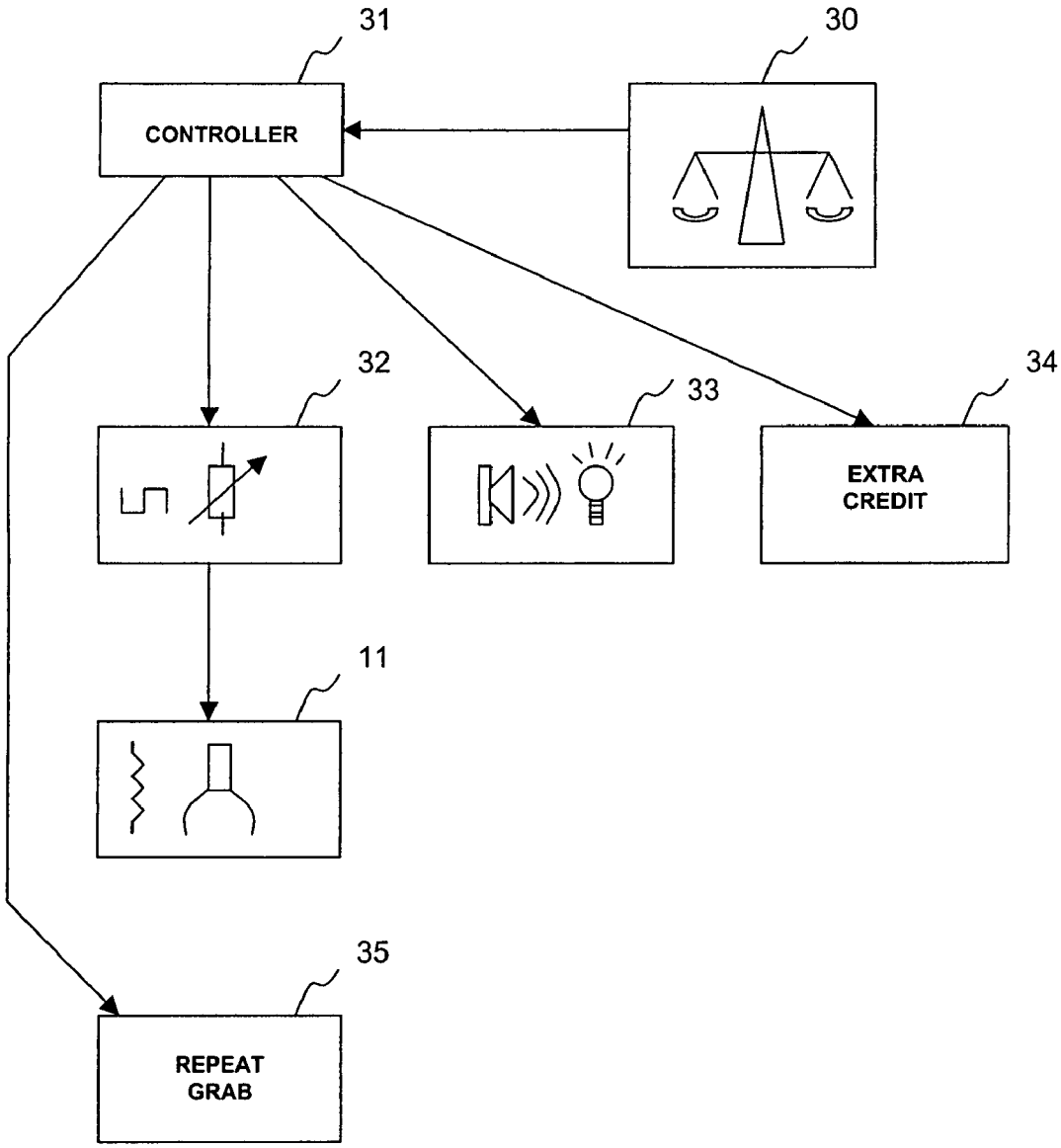
FIG. 4 is a block diagram of an arrangement of a control unit and devices connected thereto.

As illustrated in FIG. 4, the weight determined by the weight of determination device 30, i.e., the weight determined by the weighing device 12 in the first-described example embodiment and the pressure determined by the sensor 22 in the second-described example embodiment, is passed on to the control unit 31. The gripping force may be controlled on the basis of the weight determined by the weight determination device. To that end, the drive device 11 of the grabber claws may be provided with a control device 32, which is controlled by the control unit 31. Furthermore, sound and animation device(s) and/or a display device 33 may be controlled from the control unit 31. Specific effects may occur for a win or a loss in that case, which effects make the game even more attractive. Further, it is possible to provide the user with extra credit in certain situations, for example, when an object is lost, and/or to provide a new grabbing session, for example, by making a repeat grab button light up. This is schematically illustrated in FIG. 4 in the form of the "extra credit" block 34 and the "repeat grab" block 35.

Figure 5:
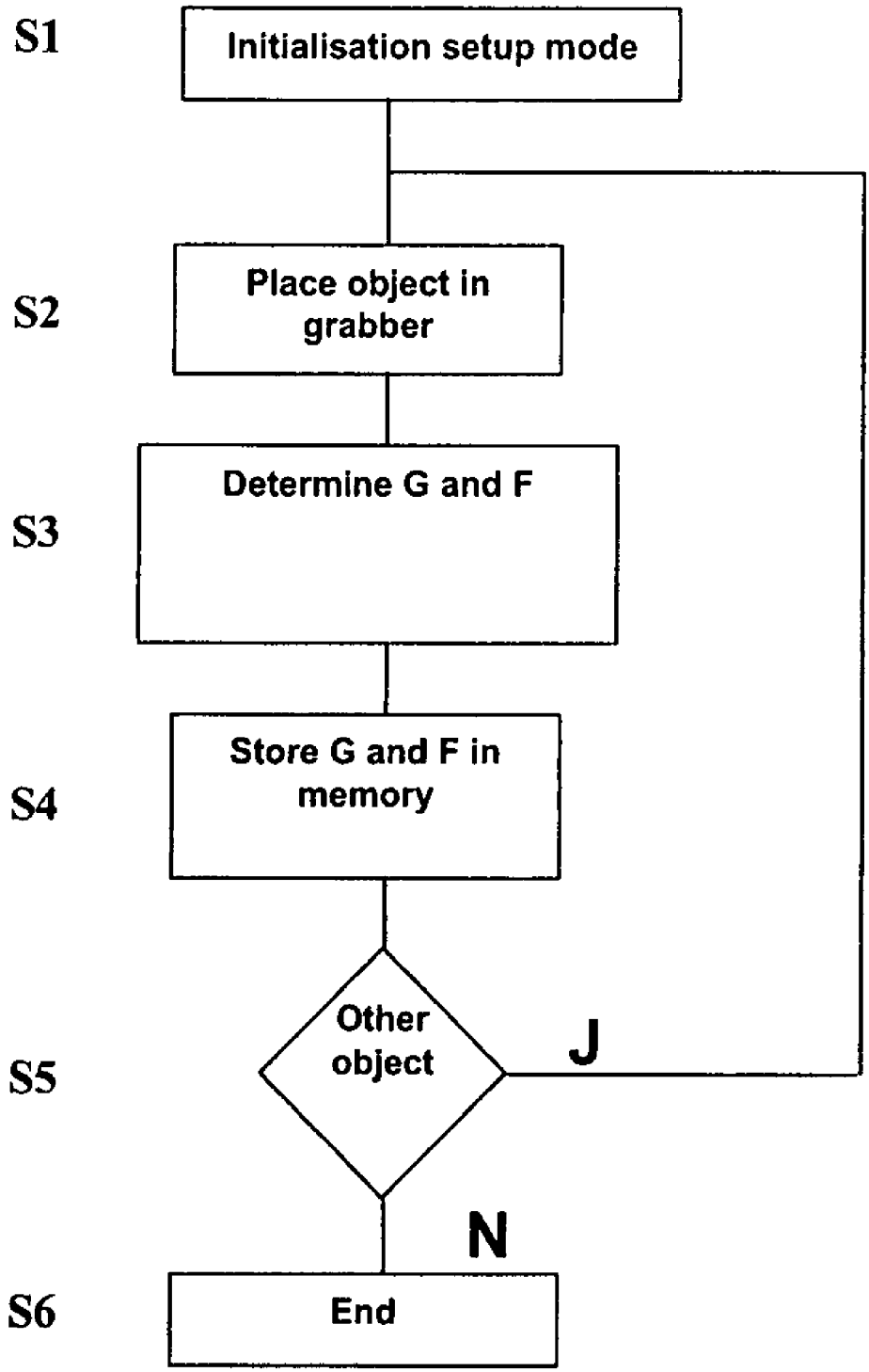
FIG. 5 is a flow diagram of an initialization method according to an example embodiment of the present invention.

A method for setting up a device, such as those described above, during an initialization procedure are described with reference to FIG. 5. In a first step S1, a set-up mode is initialized. In a second step S2, a first object to be examined is placed in the grabber. Subsequently, in step S3, the weight G of the object is determined and the gripping power for the object is calculated or determined by experiment. This may, for example, be done by experimentally determining the gripping power F at which the objects slips from the grabber. In step S4, the weight G and the gripping force F for the object is stored in a memory. Subsequently, the question whether a next object is to be examined is asked in step S5. If that is the case, the procedure will go back to step S2. If not, the initialization procedure will be terminated.

Figure 6:
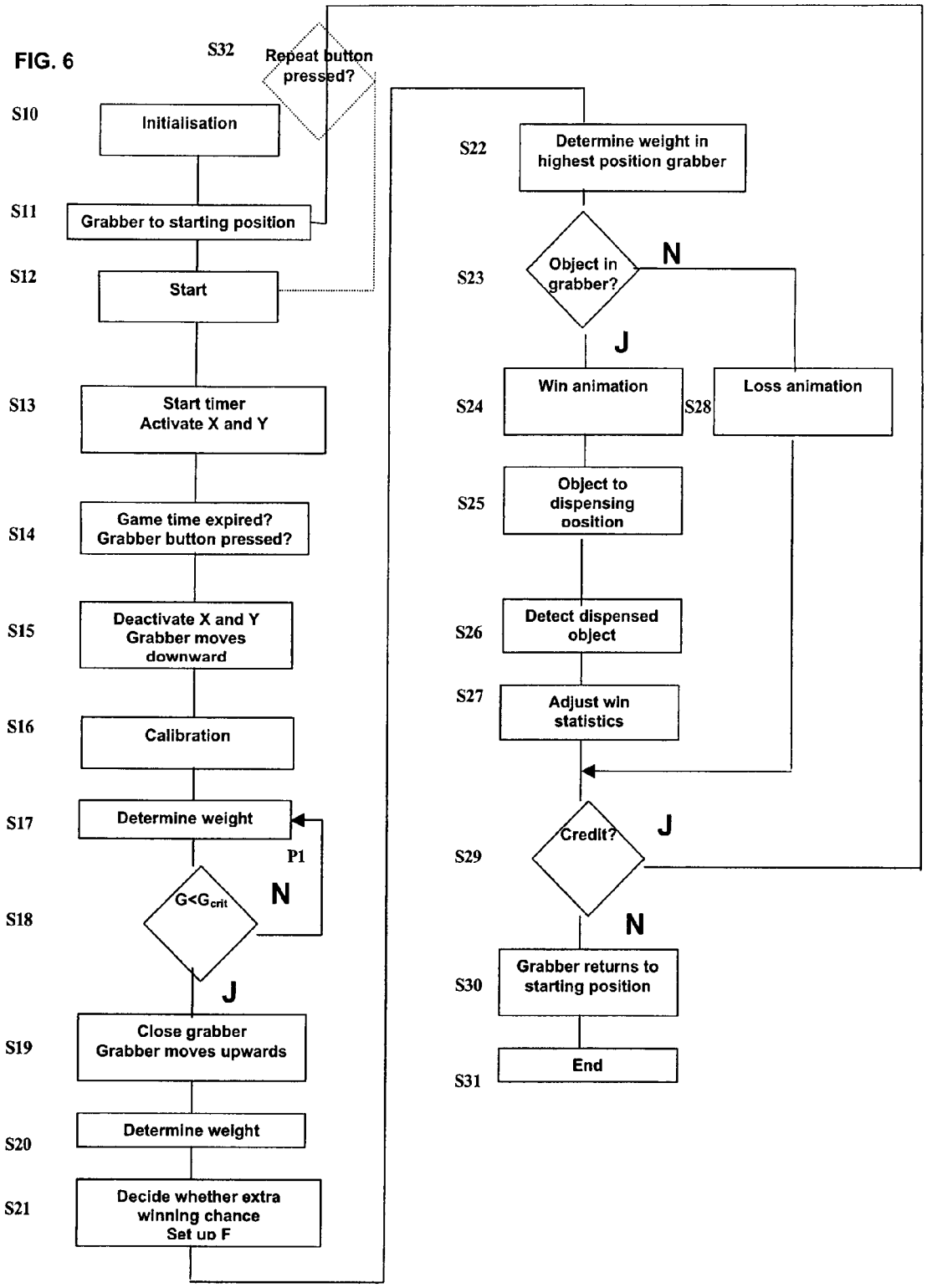
FIG. 6 is a flow diagram of a method for controlling a gripping force according to an example embodiment of the present invention.

A method according to an example embodiment of the present invention is described with reference to FIG. 6. In a first step S10, the game machine is initialized. Following this, the grabber is moved to the starting position in step S11. A game may be started by inserting a coin, but a game may also be started in a different manner, for example by pressing a repeat button, or automatically, when an extra free game is obtained, and/or by pressing a start button (step S12). In response thereto, a game timer will start to count down and the positioning device that allow movement of the grabber in the XY-direction is activated (step S13). If the game time has expired or if a grabber button is pressed (step S14), the XY-positioning device will be deactivated and the grabber will move downwardly (step S15). During this downward movement of the grabber, the weight determination device is calibrated (step S16) and the weight is determined (step S17). If the weight G is lower than a predetermined critical value $G_{crit}$ (step S18), it is concluded on the basis thereof that the grabber has reached the playing area and the grabber is closed and moved back upwardly (step S19). As long as the value G is higher than the value $G_{crit}$, the weight will be continuously determined (arrow P1). During the upward movement of the grabber, the weight is determined anew (step S20), and on the basis of the weight, it is decided whether an extra winning chance will be awarded. The decision may be taken also on the basis of the win statistics. Furthermore, the gripping power is adjusted in step S21 on the basis of the weight as determined. Once the grabber has reached its uppermost position, the weight is determined anew in step S22. On the basis of the determination, it is concluded in step S23 whether the object is still present in the grabber. If this is not the case, an audiovisual loss animation will be generated (step S28) and the game will continue with step S29. In the other case, an audiovisual win animation will be generated (step S24) and the object will be taken to the dispensing position (S25). In step S26 the presence of the dispensed object is detected, for example, by a detector that is disposed in the dispensing space, or also on the basis of the weight. Then the win statistics are adjusted (step S27) and the game continues with step S29.

In step S29, it is determined whether a player still has sufficient credit to start a new game. If this is not the case, the grabber will be returned to the starting position (S30) and the game will be terminated. If sufficient credit is still available, the system will return to step S11. According to a variant that is illustrated in dotted lines, a repeat button may or may not be pressed during a predetermined period of time if sufficient credit is still available. If the repeat button is pressed, the game will be started anew in step S12, i.e., in the current position of the grabber. If the repeat button is not pressed, the game will be continued in step S11 and the grabber will be returned to the starting position.

Those skilled in the art will appreciate that many modifications of the method are possible. For example, the calibration of step S16 might be effected at a different point in time. Furthermore, steps S20, S21 and S27 may be omitted. The generation of audiovisual animation is not a requirement.

Figure 7:
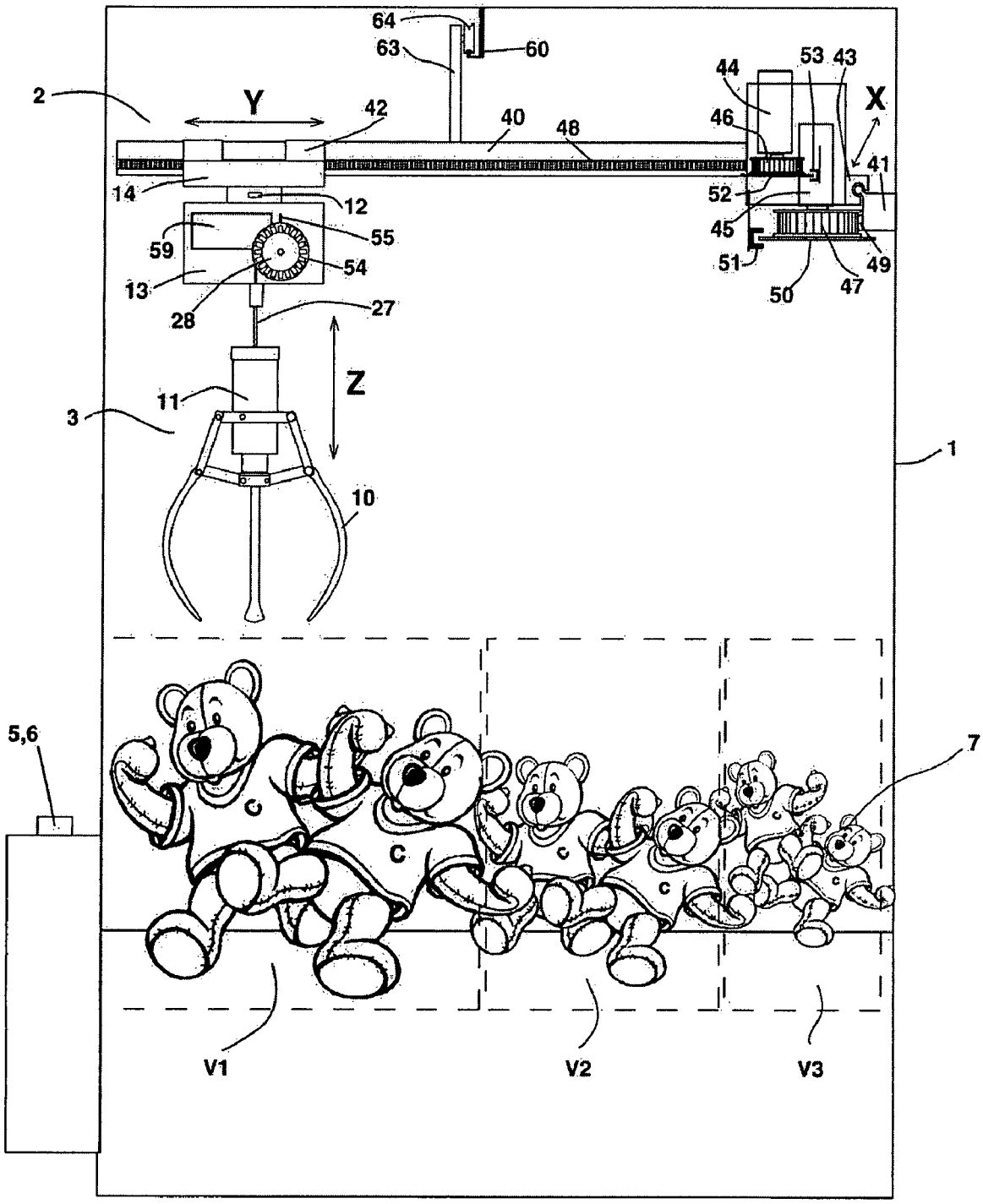
FIG. 7 is a side view of a device according to an example embodiment of the present invention.

Now another aspect, e.g., the positioning device, is described with reference to FIGS. 7 and 8. The illustrated grabber 3 is movable in the X-, Y- and Z-directions. The X-direction extends parallel to the front of the cabinet, the Y-direction extends parallel to the side of the cabinet and the Z-direction is the direction in which the grabber moves downwardly, as indicated by the arrows X, Y, Z in FIG. 7. The movement in the X-direction is made possible by a sliding piece 43, which is movable, via a slide bearing, along a section 41 that is connected to the cabinet. The sliding piece 43 is connected to a section 40 extending in the Y-direction, along which the second sliding piece 42 is movable via slide bearings. To reduce the forces on the section 40, the section 40 is suspended, substantially in the center thereof, from a section 60 extending in the X-direction, which is connected to the upper side of the cabinet. The suspension may, for example, be configured with a vertical connecting piece 63, which may move along the section 60 via a runner 64.

Such a construction therefore allows movement in the X- and Y-directions of the carriage 2 connected to the grabber. The movement in the Z-direction is effected by a cord 27 which may be wound on a wheel 28 that is mounted to the carriage 2.

In the illustrated arrangement, the movement in the X-, Y- and Z-directions is driven by motors 45, 44 and 59, respectively. To effect the movement in the Y-direction, the motor 44 is provided with a pulley 46, the rotary motion of which is converted into linear motion via a toothed belt 48, which is connected to the sliding piece 42. Analogously, a motor 45 provided with a belt pulley 47 effects the movement in the X-direction. The movement in the Z-direction is effected by the motor 59, which is connected to the wheel 28 for winding/unwinding the cord 27.

The moving device may be arranged that the current position of the grabber is known at any point in time. To that end, device(s) for detecting the movement are provided. In the illustrated example embodiment, the detection of the movement may take place in one of the following manners: by an encoder that is integrated in the motor 44, 45, 49, which encoder registers the revolutions of the motor; by an external disc 52, 50, 54 provided with indicators, which disc is connected to the rotary shaft of the motor 44, 45, 59, and a sensor 53, 51, 55 for detecting the indicators (the indicators may be configured as slots formed in the disc, for example); a linear slat, which is for example fixed to the sections 40 and 41, the movement along which is measured by a sensor, which is, for example, mounted on the bearings.

The use of such detection devices thus makes it possible to realize an accurate determination of the position at any point in time, thereby providing an interactive control of the range of movement of the carriage. By providing the sections 40 and 41 with limiting stops, the range of movement of the carriage 2 with the grabber 3 is limited. The range of movement of the carriage 2 may be scanned and registered during startup, after which the moving device may be controlled such that the carriage will stop just before it reaches the end of a section. This may eliminate the need to use limiter contacts.

Such a position determination furthermore makes it possible to register specific positions that are linked to a specific action. Thus, positions may be registered where the grabber must not be lowered, positions where a picked-up object must be released (for example, over the prize delivery chute), etc. This makes it possible to use any location in the cabinet for the prize delivery chute.

The playing area may be divided into (whether or not imaginary) sections V1, V2, V3, in which sections objects of different value are present, which objects are each linked to their own payout specifications.

If weight determination device 12 is provided, the following control arrangement may be provided. The weight determination device 12 detects whether the grabber has released an object, and the movement detection device determines and stores the position at which this has taken place. The grabber may be returned to the position at a later point in time in that case. This does not necessarily have to be the position at which the grabber carried out its latest grabbing action.

Figure 8:
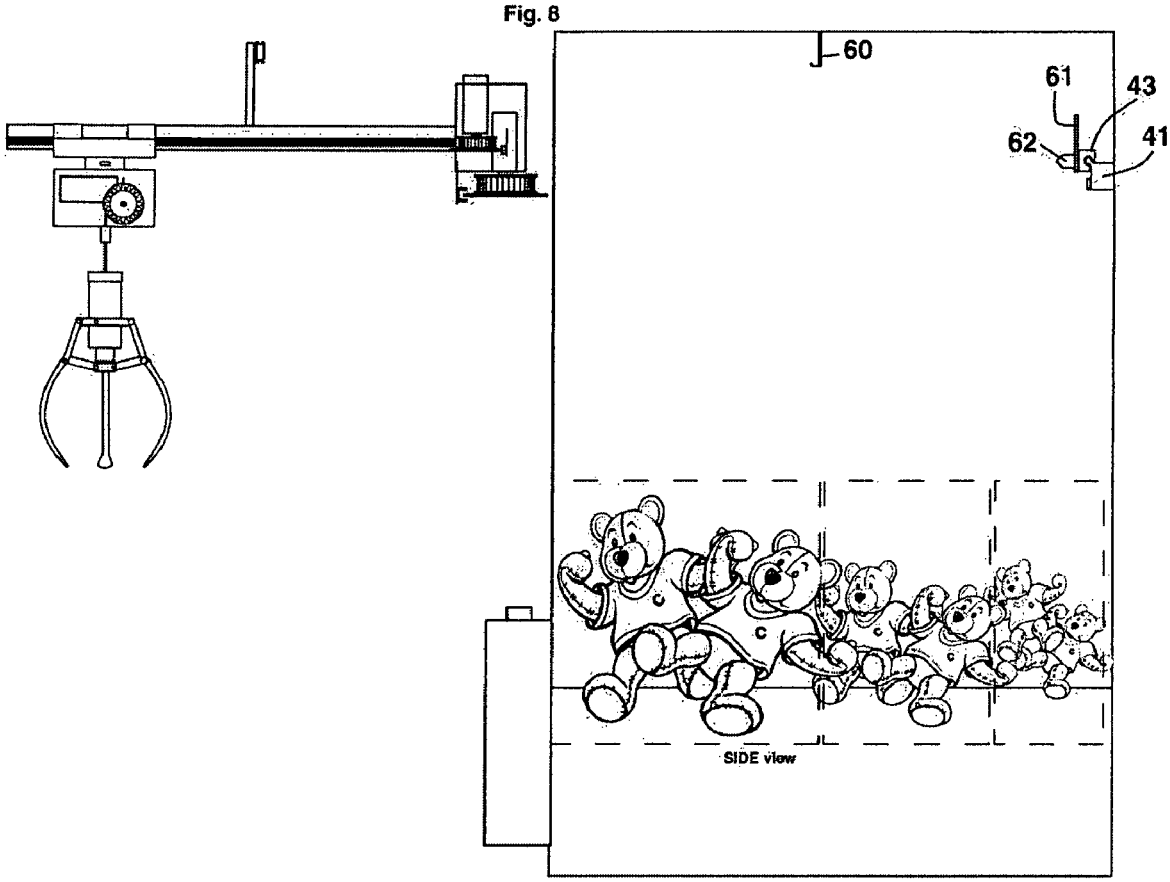
FIG. 8 is a view, analogous to the view of FIG. 7, but wherein part of the grabber unit is removed from the cabinet.

As illustrated in FIG. 8, the grabbing unit is divided into a part that remains suspended in the cabinet and a part that may be removed from the cabinet. The parts that are fixedly mounted in the cabinet include: the suspension section 40 and the section 41 extending in the X-direction, to which a sliding piece 43 is mounted. The sliding piece 43 includes a plate 61, on which a self-locating connector, for example, a self-locating Molex™ connector, is disposed. The connector mates with a complementary component on the removable part of the grabber unit. The plate 61 is further provided with a guide 62 to provide easy positioning of the removable part of the grabber unit thereon.

Note that the point at which the removable part of the grabber unit is so suspended is a fulcrum point. When the carriage 2 with the grabber 3 moves in the Y-direction from a position in front of the fulcrum point to a position behind the fulcrum point, the direction of the forces exerted on the slide bearings 42 and of the forces exerted on the section 41 is reversed from upwardly to downwardly. Because of this, it may be provided to use slide bearings for the movement of the sliding piece 42 along the section and for the movement of the sliding piece 43 along the section 41.

By using a removable part of the grabber unit, as illustrated in FIG. 8, a very flexible construction may be obtained. More particularly, the removable part of the grabber unit may be suitable for cabinets with different widths of the playing area.

Figure 9:
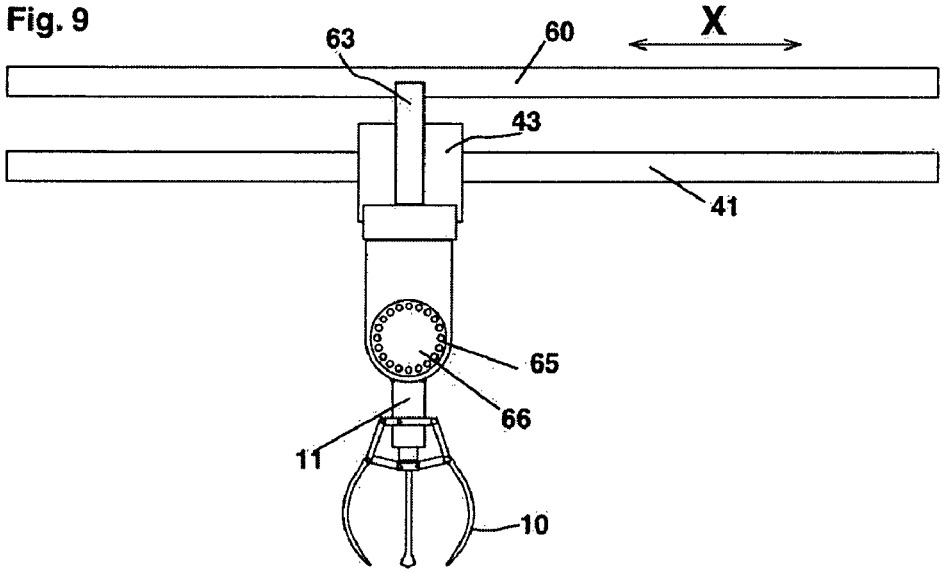
FIG. 9 is a schematic front view of a device according to an example embodiment of the present invention.

FIG. 9 is a front view of the carriage 2 which is movable in the X-direction along the section 41. In the arrangement illustrated in FIG. 9, a number of attention-attracting devices are provided, e.g., in the form of LEDs 65, which are disposed at a position that is conspicuous to the player or to a passer-by, e.g., at the front side of the carriage 2. The LEDs may indicate the existence of a special condition of the game machine to the player and/or the passer-by. The condition may be a so-called "happy time," for example, which indicates a period during which double the amount of credits is obtained upon insertion of money or a token. At the end of such a so-called "happy time" period, the LEDs may go out one by one, for example, until all the LEDs are out, such that the counting down of the remaining time will be apparent to a player or a passer-by.

Such a "happy time" period may, for example, be linked to a specific condition of the game machine. Thus, the game machine may, for example, keep track of the time the machine is being used, and in case of a long period of inactivity, it may promote itself by offering a "happy time" period. According to another possibility, a "happy time" may be offered when the player is using up his last credit.

Note that the device(s) for attracting the attention may also include sound devices, audiovisual devices, etc. An advantage of such a system is that the grabber machine itself may determine, on the basis of its takings, popularity, etc, whether a "happy time" is to be generated.

What is claimed is:

1. A device for picking up at least one object and subsequently moving the at least one object to a dispensing position, comprising:

a pick-up device;

a positioning device controllable by a user to position the pick-up device over at least one object;

a weight determination device configured to determine at least one of (a) a weight of the pick-up device, in which at least one picked-up item is present for a successful pick-up attempt, and (b) a variable related to the weight; and a control device configured to control a pick-up force as a function of the weight determined by the weight determination device.

2. The device according to claim 1, wherein the object includes at least one prize to be won.

3. The device according to claim 1, wherein the pick-up device includes at least one of (a) a grabber and (b) a vacuum head.

4. The device according to claim 1, wherein the weight determination device includes a weighing cell.

5. The device according to claim 4, further comprising a vertical movement device suspended from the weighing cell with the pick-up device.

6. The device according to claim 1, wherein the weight determination device includes a pressure sensor.

7. The device according to claim 6, further comprising a vertical movement device, the pick-up device suspended from the vertical movement device, the vertical movement device movably mounted, the vertical movement device exerting a pressure force on the pressure sensor by its own weight and by weight of the pick-up device, in which at least one object may be present.

8. The device according to claim 7, wherein the vertical movement device is pivotally connected to a carriage movable in a horizontal plane by the positioning device, the carriage including an abutment surface, the pressure sensor attached to the abutment surface.

9. The device according to claim 1, wherein a repeat control function is configured to provide a further pick-up attempt if the weight determined on a first pick-up attempt indicates that no object was picked up.

10. The device according to claim 1, further comprising:

an audiovisual animation device; and a control unit configured to control the audiovisual animation device in accordance with the weight determined by the weight determination device.

11. A device for picking up at least one object of at least one type and subsequently moving the at least one object to a dispensing position, comprising:

a pick-up device;

a positioning device controllable by a user to position the pick-up device over at least one object;

a weight determination device configured to determine at least one of (a) a weight of the pick-up device, in which at least one picked-up item is present for a successful pick-up attempt, and (b) a variable related to the weight; and a control unit configured to derive a type of object on in accordance with the weight determined by the at least one of (a) the weight and (b) the variable related to the weight.

12. The device according to claim 11, wherein the object includes at least one prize to be won.

13. The device according to claim 11, wherein the pick-up device includes at least one of (a) a grabber and (b) a vacuum head.

14. A device for picking up at least one object and subsequently moving the at least one object to a dispensing position, comprising:

a pick-up device;

a positioning device controllable by a user to position the pick-up device over at least one object;

a weight determination device configured to determine at least one of (a) a weight of the pick-up device, in which at least one picked-up item is present for a successful pick-up attempt, and (b) a variable related to the weight;

a vertical movement device configured to move the pick-up device up and down; and a control unit configured to control the vertical movement device in accordance with the weight determined by the weight determination device.

15. The device according to claim 14, wherein the object includes at least one prize to be won.

16. The device according to claim 14, wherein the pick-up device includes at least one of (a) a grabber and (b) a vacuum head.

17. A method for setting up a device during an initialization procedure of a device for picking up at least one object of at least one type and subsequently moving the at least one object to a dispensing position, which the device including a pick-up device and a positioning device controllable by a user to position the pick-up device over at least one object, comprising:

(a) determining at least one of (a) a weight of all types of objects to be picked up and (b) a variable related to the weight by a weight determination device; and (b) storing the at least one of (a) the weight of all types of objects to be picked up and (b) the variable related to the weight determined in the determining step (a).

18. The method according to claim 17, wherein the object includes at least one prize to be won.

19. The method according to claim 17, further comprising:

(c) determining a required pick-up force for every type of object; and (d) storing the required pick-up force determined in the determining step (c).

20. The method according to claim 19, wherein the required pick-up force is determined in the determining step (c) at least one of (a) automatically and (b) non-automatically.

21. A method for determining statistical data of a device for picking up at least one object of at least one type and subsequently moving the object to a dispensing position, the device including a pick-up device and a positioning device controllable by a user to position the pick-up device over at least one object, comprising:

for each pick-up attempt, determining a weight of a picked up object; and storing the weight determined in the determining step.

22. The method according to claim 21, wherein the object includes at least one prize to be one.

23. A method for controlling a device for picking up at least one object of at least one type and subsequently moving the object to a dispensing position, comprising:

determining at least one of (a) a weight of the pick-up device, in which at least one object is present for a successful pick-up attempt, and (b) a variable related to the weight;

deriving, from the determined weight, whether an object was picked up; and deriving, from the determined weight, which type of object was picked up.

24. The method according to claim 23, wherein the object includes at least one prize to be won.

25. The method according to claim 23, further comprising adjusting a pick-up force in accordance with the determined weight to at least one of (a) increase and (b) decrease a winning chance.

26. The method according to claim 23, further comprising:

deriving, in accordance with the determined weight, if a picked-up object is falling from the pick-up device; and adjusting the pick-up force if it is derived that the picked-up object is falling.

* * * * *